US007125347B2

(12) United States Patent
Kawamatsu

(10) Patent No.: US 7,125,347 B2
(45) Date of Patent: Oct. 24, 2006

(54) GOLF BALL AND GOLF BALL MANUFACTURING METHOD

(75) Inventor: Hideaki Kawamatsu, Kobe (JP)

(73) Assignee: SRI Sports Ltd., Kobe (JP)

( * ) Notice: Subject to any disclaimer, the term of this patent is extended or adjusted under 35 U.S.C. 154(b) by 0 days.

(21) Appl. No.: 10/626,764

(22) Filed: Jul. 25, 2003

(65) Prior Publication Data

US 2004/0162159 A1 Aug. 19, 2004

(30) Foreign Application Priority Data

Aug. 28, 2002 (JP) ..... 2002-248670

(51) Int. Cl.
*A63B 37/12* (2006.01)

(52) U.S. Cl. ..... 473/378

(58) Field of Classification Search ..... 473/351, 473/378, 373, 374

See application file for complete search history.

(56) References Cited

U.S. PATENT DOCUMENTS 5,836,834 A 11/1998 Masutani et al.
6,213,897 B1 4/2001 Masutani
6,267,695 B1 7/2001 Masutani
6,544,130 B1 * 4/2003 Weidenhammer ..... 473/351
6,595,875 B1 * 7/2003 Oh ..... 473/374
6,773,364 B1 * 8/2004 Sullivan et al. ..... 473/370

FOREIGN PATENT DOCUMENTS

JP 9-285565 A 11/1997
JP 2000-330 A 1/2000
JP 2000-5343 A 1/2000

* cited by examiner

*Primary Examiner*—Raeann Gorden
(74) *Attorney, Agent, or Firm*—Birch, Stewart, Kolasch & Birch, LLP

(57) ABSTRACT

A golf ball including a spherical core and a cover. The cover has a nominal thickness of 0.1 mm to 1.2 mm. A dimple is formed on the surface of the cover. A concave portion is formed on the surface of the core. The position of the concave portion corresponds to that of the dimple. The golf ball is obtained by forming the core by means of a mold having a large number of projections provided on a cavity surface thereof. By the projections, the concave portion is formed. When the cover is to be formed, the position of the core is determined in such a manner that the projections for forming the dimple correspond to the concave portions.

30 Claims, 7 Drawing Sheets

GOLF BALL AND GOLF BALL MANUFACTURING METHOD

BACKGROUND OF THE INVENTION

1. Field of the Invention

The present invention relates to a golf ball. More particularly, the present invention relates to a golf ball comprising a cover having a small thickness.

2. Description of the Related Art

General golf balls excluding golf balls manufactured for a driving range comprise cores and covers. The core is formed by a single solid rubber layer, two or more solid rubber layers, a solid rubber layer and a synthetic resin layer or the like.

It is important for golf ball manufactures to manufacture a uniform golf ball. There have variously been proposed a method of manufacturing a golf ball having a multilayer structure (Japanese Laid-Open Patent Publications Nos. Hei 9-285565 (1997/285565) 2000-330 and 2000-5343).

Examples of characteristics required for a golf ball by a golf player include a long flight distance, an excellent spin performance and a soft hitting feeling. In hitting with a driver, the golf player attaches importance to the flight distance. In hitting with a short iron, the golf player attaches importance to the spin performance and the hitting feeling. In order to correspond to various characteristics which are required, there has been proposed a golf ball comprising a cover having a small thickness.

A golf ball has approximately 200 to 550 dimples on a surface thereof. The role of the dimples resides in one aspect that such dimples disturb an air stream around the golf ball during the flight to accelerate the transition of a turbulent flow at a boundary layer, thereby causing a turbulent flow separation. The acceleration of the transition of the turbulent flow causes a separating point of air from the golf ball to be shifted backward so that a drag coefficient (Cd) is reduced, resulting in an increase in the flight distance of the golf ball. The acceleration of the transition of the turbulent flow increases a differentia between upper and lower separating points of the golf ball which is caused by back spin. Consequently, the lift action on the golf ball is increased. The dimple effect greatly depends on the volume of the dimple.

The thickness of the cover provided under the dimple is smaller than that of the cover of a land portion thereof (which will be hereinafter referred to as a "nominal thickness"). Usually, the depth of the dimple is more than 0.2 mm. In the case of a golf ball having a nominal thickness of 1.2 mm or less, the thickness of the cover provided under the dimple is extremely small. In some cases in which the golf ball is repetitively hit, the dimple acts as the starting point of a crack and the cover is thus broken.

If the nominal thickness is less than the depth of the dimple, the core is exposed to the bottom portion of the dimple. Also in the case in which the nominal thickness is greater than the depth of the dimple, there is a possibility that the core might be exposed to the bottom portion of the dimple if the eccentricity of the core (the center of the core is shifted from that of the golf ball) is caused. In a golf ball having a small nominal thickness, the core is apt to be exposed due to eccentricity. The durability of the golf ball remarkably deteriorates due to the exposure of the core. The exposure of the core decreases the volume of the dimple so that the dimple effect is reduced. Also, the exposure of the core is not desirable for external appearances.

In cover molding, a core is put in a mold. A molten cover material flows in a gap between the core and the cavity surface of the mold. The cavity surface of the mold is provided with a projection having a shape obtained by inverting the shape of a dimple. In the case in which a cover having a small nominal thickness is to be formed, the flow of the cover material is hindered by the projection because the distance between the projection and the core is extremely small. Thus, it is hard to form a cover having a small nominal thickness.

SUMMARY OF THE INVENTION

The golf ball according to the present invention comprises a core, a cover having a nominal thickness of 0.1 mm to 1.2 mm and a dimple formed on a surface of the cover. Concave portions (dimples) are formed on the surface of the core and the position of the concave portions correspond to that of the dimples.

In the golf ball, the presence of concave portions on the surface of the core can prevent the thickness of the cover disposed under the dimple from being extremely reduced. In the golf ball, it is thus possible to prevent a crack starting from the dimple. In the golf ball, the exposure of the core can be suppressed. The cover of the golf ball can easily be formed. It is thus possible to obtain the golf ball by forming the cover while positioning the core to cause the projection of the cover mold to correspond to the concave portions of the core.

The present invention provides a golf ball manufacturing method comprising the steps of:

(1) forming a core including a large number of concave portions provided on the surface thereof by means of a core mold having a spherical cavity surface and a large number of projections provided on the cavity surface; and (2) placing the core in a cover mold including a spherical cavity surface with a large number of projections formed on the cavity surface and a holding pin holding the core in the center of the cavity by means and filling the gap between the cavity surface and the core with a cover material.

A predetermined concave portion is caused to abut on the tip of the holding pin so that the core is positioned in such a manner that the concave portions correspond to the projections (convex portions) at the cover forming step.

In the manufacturing method, it is possible to obtain a golf ball in which the position of the concave portions of the core correspond to the dimples of the cover. By the manufacturing method, it is possible to easily obtain a golf ball comprising a cover having a small nominal thickness. It is preferable that the depth of the concave portion abutting on the tip of the holding pin should be greater than the depths of the other concave portions.

The present invention provides another golf ball manufacturing method comprising the steps of:

(1) forming a core including a large number of concave portions provided on the surface thereof utilizing a core mold having a spherical cavity surface and a large number of projections provided on the cavity surface;

(2) causing a large number of projections formed on a hemispherical cavity surface to abut on the concave portions to hold the core in a predetermined position by using a core holding mold having the cavity surface and the projections;

(3) pouring a reaction curing type resin composition into a first half mold of the cover mold including the first half mold and a second half mold which have semispherical cavity surfaces and a large number of projections provided on the cavity surfaces, thereby causing the resin composition to gelate;

(4) joining the first half mold and the core holding mold together in such a manner that the projections of the first half mold correspond to the concave portions, thereafter curing the resin composition;

(5) pouring a reaction curing type resin composition into the second half mold, thereby causing the resin composition to gelate; and (6) holding the core by the first half mold and joining the first half mold and the second half mold together in such a manner that the projections of the second half mold correspond to the concave portions, thereafter curing the resin composition.

In the manufacturing method, it is possible to obtain a golf ball in which the position of the concave portions of the core corresponds to the dimples of the cover. By this manufacturing method, it is possible to easily obtain a golf ball comprising a cover having a small nominal thickness.

BRIEF DESCRIPTION OF THE DRAWINGS

The present invention will become more fully understood from the detailed description given hereinbelow and the accompanying drawings, which are given by illustration only, and thus are not limitative of the present invention, and wherein.

DESCRIPTION OF THE PREFERRED EMBODIMENTS

Preferred embodiments of the present invention will be described below in detail with reference to the drawings.

Figure 1:
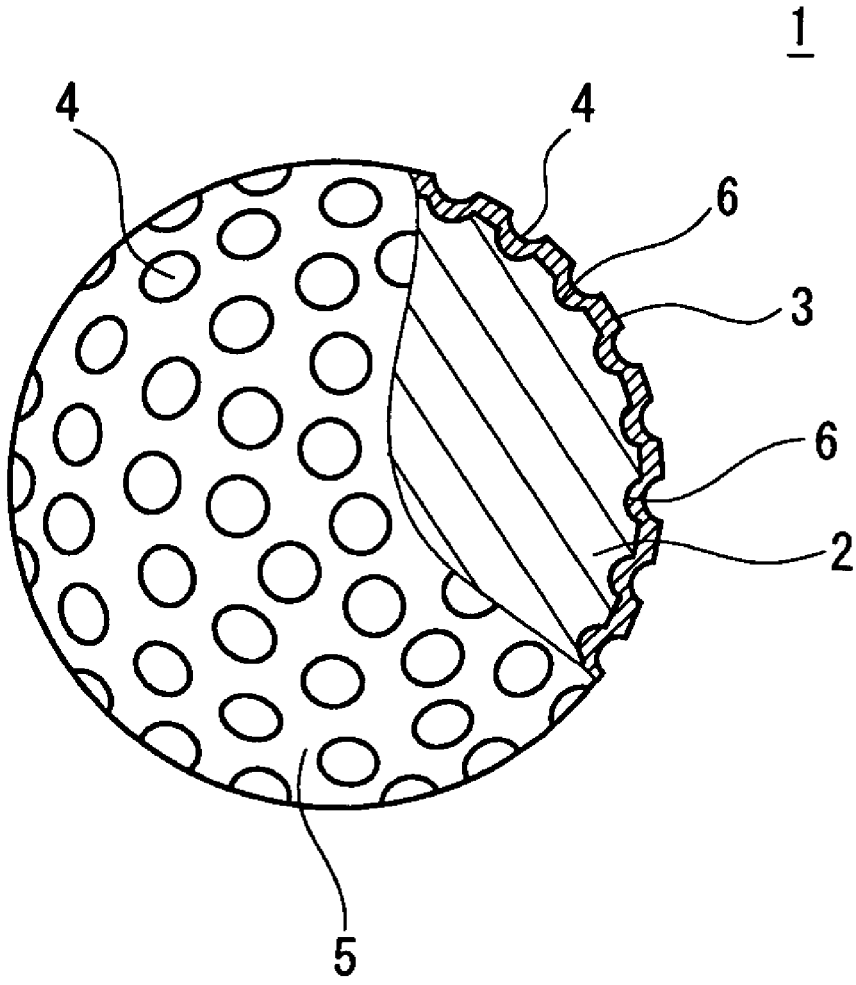
FIG. 1 is a typical sectional view showing a golf ball according to an embodiment of the present invention.

A golf ball 1 shown in FIG. 1 comprises a spherical core 2 and a cover 3. A dimple 4 is formed on the surface of the cover 3. The surface of the cover 3 other than the dimples 4 includes a land portion 5. The dimple 4 has a circular planar shape. A concave portion 6 is formed on the surface of the core 2. The concave portion 6 has a circular planar shape. The golf ball 1 has a paint layer and a mark layer on the outside of the cover 3, which are not shown.

The golf ball 1 has a diameter of 40 mm to 45 mm, and furthermore, 42 mm to 44 mm. In consideration of a reduction in an air resistance within such a range that the standards of the United States Golf Association (USGA) are satisfied, it is particularly preferable that the diameter should be 42.67 mm to 42.80 mm. The golf ball 1 has a weight of 40 g to 50 g, and furthermore, 44 g to 47 g. In consideration of an enhancement in an inertia within such a range that the standards of the USGA are satisfied, it is particularly preferable that the weight should be 45.00 g to 45.93 g.

The core 2 is formed by a rubber composition. The cover 3 is formed by a resin composition. The core 2 shown in FIG. 1 has a single layer structure but may be constituted by two or more layers. The inner layer of the core having a two-layer structure is usually formed by a rubber composition. The outer layer of the core having the two-layer structure is formed by a rubber composition or a resin composition.

In this specification, the cover 3 implies an outermost layer excluding a paint layer and a mark layer. There is also a golf ball in which a cover has a two-layer structure. In this case, however, an outer layer corresponds to the cover 3 in this specification and an inner layer corresponds to a part of the core 2. In this specification, the core 2 implies a sphere in which a surface thereof is provided in contact with the inner peripheral surface of the cover 3. There is also a golf ball in which a mid layer is present between the core and the cover. In this case, the mid layer corresponds to a part of the core 2.

The cover 3 has a nominal thickness of 0.1 mm to 1.2 mm. In some cases in which the nominal thickness is less than the range, it is hard to form the cover 3. From this viewpoint, it is more preferable that the nominal thickness should be 0.3 mm or more. In some cases in which the nominal thickness is more than the range, it is hard to cause the flight performance and the hitting feeling of the golf ball 1 to be consistent with each other. From this viewpoint, it is more preferable that the nominal thickness should be 1.0 mm or less. A regular octahedron inscribed on a phantom sphere of the golf ball can be supposed. For each of six vertexes of the regular octahedron, the land portion 5 which is the closest to the vertex is determined. The thicknesses of the cover 3 measured in these six land portions 5 are averaged so that a nominal thickness T is calculated.

As is apparent from FIG. 1, the position of the concave portions 6 corresponds to that of the dimples 4. In other words, one concave portion 6 having the polar coordinates of a spherical surface defined by a latitude and a longitude which are substantially identical to those of the dimple 4 is present under one dimple 4.

Figure 2:
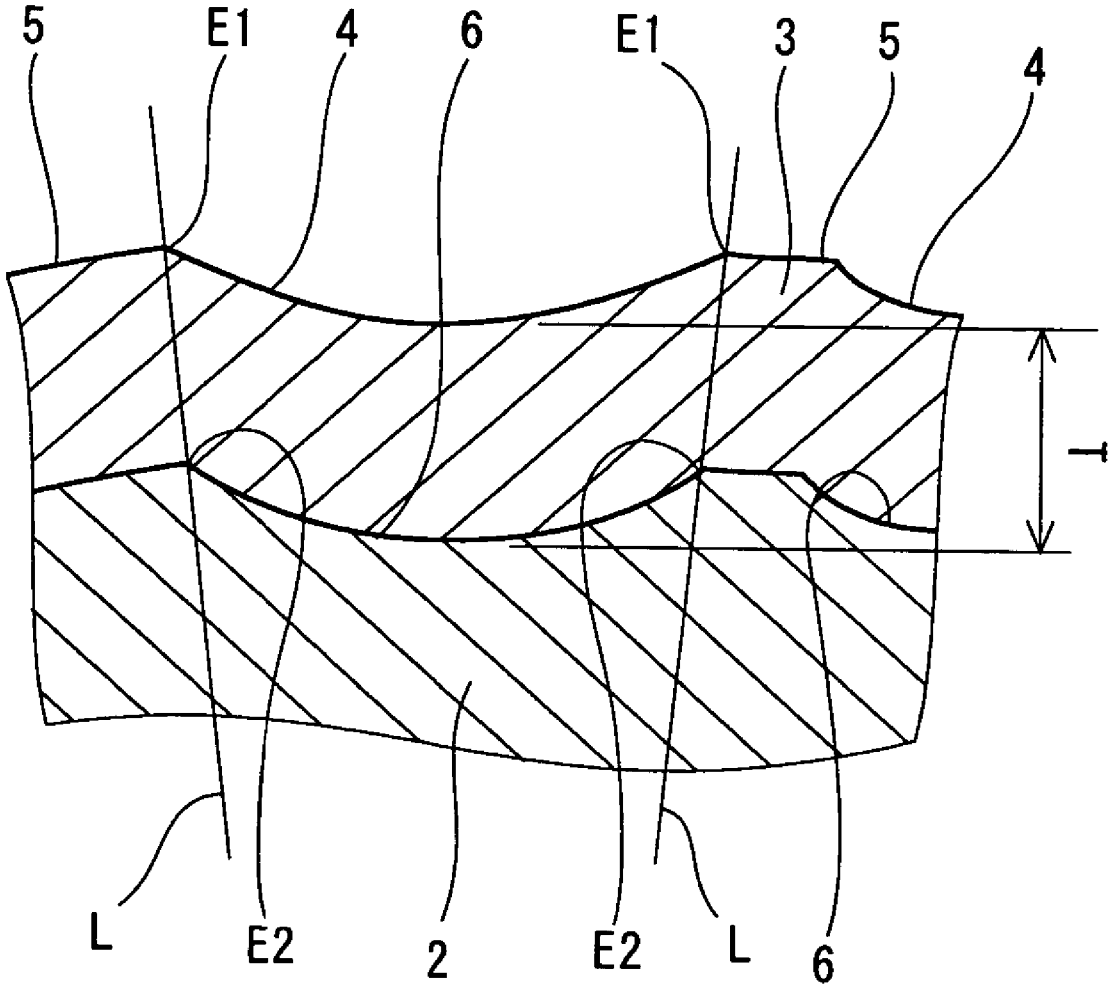
FIG. 2 is an enlarged sectional view showing a part of the golf ball in FIG. 1.

FIG. 2 is an enlarged sectional view showing a part of the golf ball 1 in FIG. 1. As described above, the concave portion 6 is formed in a position corresponding to the position of the dimple 4. Therefore, the thickness T of the cover 3 provided under the deepest portion of the dimple 4 is sufficiently large. Even if the golf ball 1 is repetitively hit, the cover 3 provided under the dimple 4 can be prevented from being the starting point of a crack. The thickness T of the cover 3 is preferably 60% to 140% of a nominal thickness and particularly preferably 80% to 120% thereof.

Also in the case in which the core 2 is slightly eccentric, it is possible to prevent the core 2 from being exposed to the bottom portion of the dimple 4 because the concave portion 6 is formed on the core 2. Accordingly, the external appearance of the golf ball 1 is not adversely affected. Since the exposure is prevented, the volume of the dimple 4 can be prevented from being reduced by the exposed portion of the core. The golf ball 1 also has an excellent flight performance.

With respect to the prevention of exposure, the diameter of the concave portion 6 is preferably 60% to 140% of the diameter of the dimple 4, particularly preferably 80% to 120% thereof and most preferably 90% to 110% thereof. With respect to the prevention of the exposure, the depth of the concave portion 6 is preferably 60% to 140% of the depth of the dimple 4 and particularly, preferably 80% to 120% thereof. The depth of the concave portion 6 is the distance between the spherical surface of the core 2 and the deepest portion of the concave portion 6 on the assumption that the concave portion 6 is not present. The depth of the dimple 4 is the distance between the spherical surface of the golf ball 1 and the deepest portion of the dimple 4 on the assumption that the dimple 4 is not present.

The ideal shape of the concave portion 6 is analogous to that of the dimple 4. More specifically, an edge E2 of the concave portion 6 is positioned on a straight line L passing through an edge E1 of the dimple 4 and the center (not shown) of a sphere of the golf ball 1. When the distance between the edge E1 and the center of the sphere is represented as L1 and the distance between the edge E2 and the center of the sphere is represented as L2, the diameter of the concave portion 6 is (L2/L1) times as great as the diameter of the dimple 4. The depth of the concave portion 6 is (L2/L1) times as great as the depth of the dimple 4.

The ratio of the number of the dimples 4 having the concave portion 6 provided thereunder to the total number of the dimples 4 is preferably 60% or more, more preferably 80% or more and ideally 100%.

While the dimple 4 of the golf ball 1 in FIG. 1 is circular, a non-circular dimple may also be formed. Specific examples of the non-circular dimple include an elliptical dimple, an oblong dimple, a teardrop-shaped dimple, a polygonal dimple, a stripe groove-shaped dimple, and the like. The circular dimple 4 and the non-circular dimple may be provided together. In the case in which the non-circular dimple is provided, a non-circular concave portion is provided thereunder.

Figure 3:
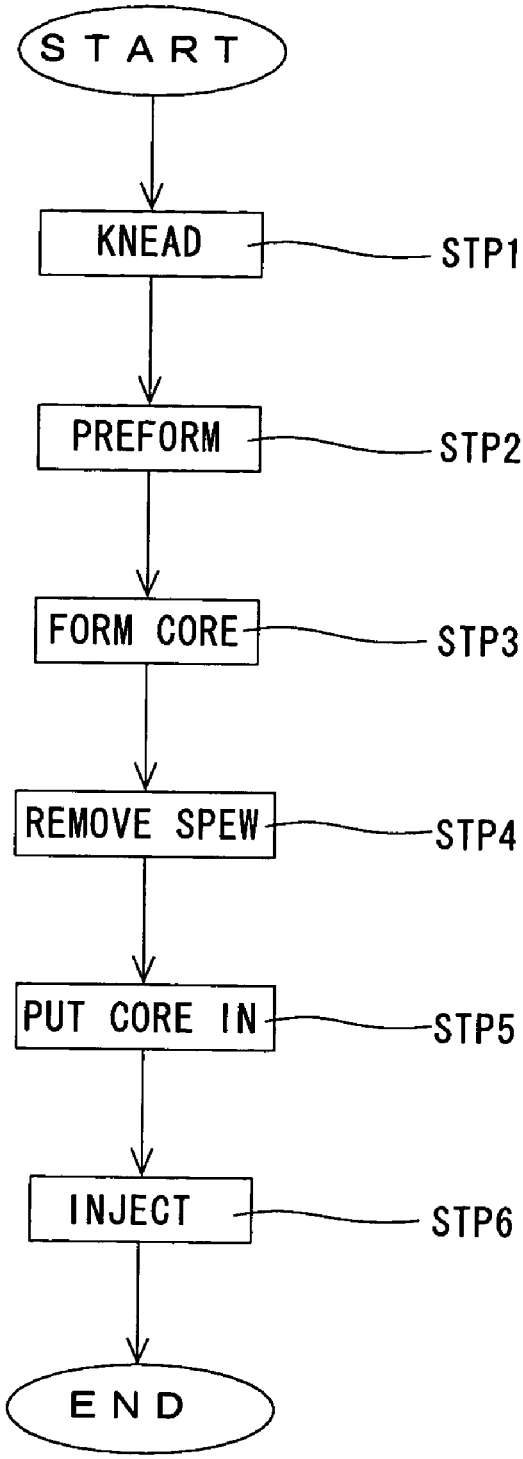
FIG. 3 is a flow chart showing a golf ball manufacturing method according to an embodiment of the present invention.

FIG. 3 is a flow chart showing a golf ball manufacturing method according to an embodiment of the prevent invention. In the manufacturing method, first of all, a base rubber and an additive are kneaded so that a rubber composition is obtained (STP1). Next, a preforming material is formed by the rubber composition (STP2). The preforming material takes a cylindrical shape, for example.

Figure 4:
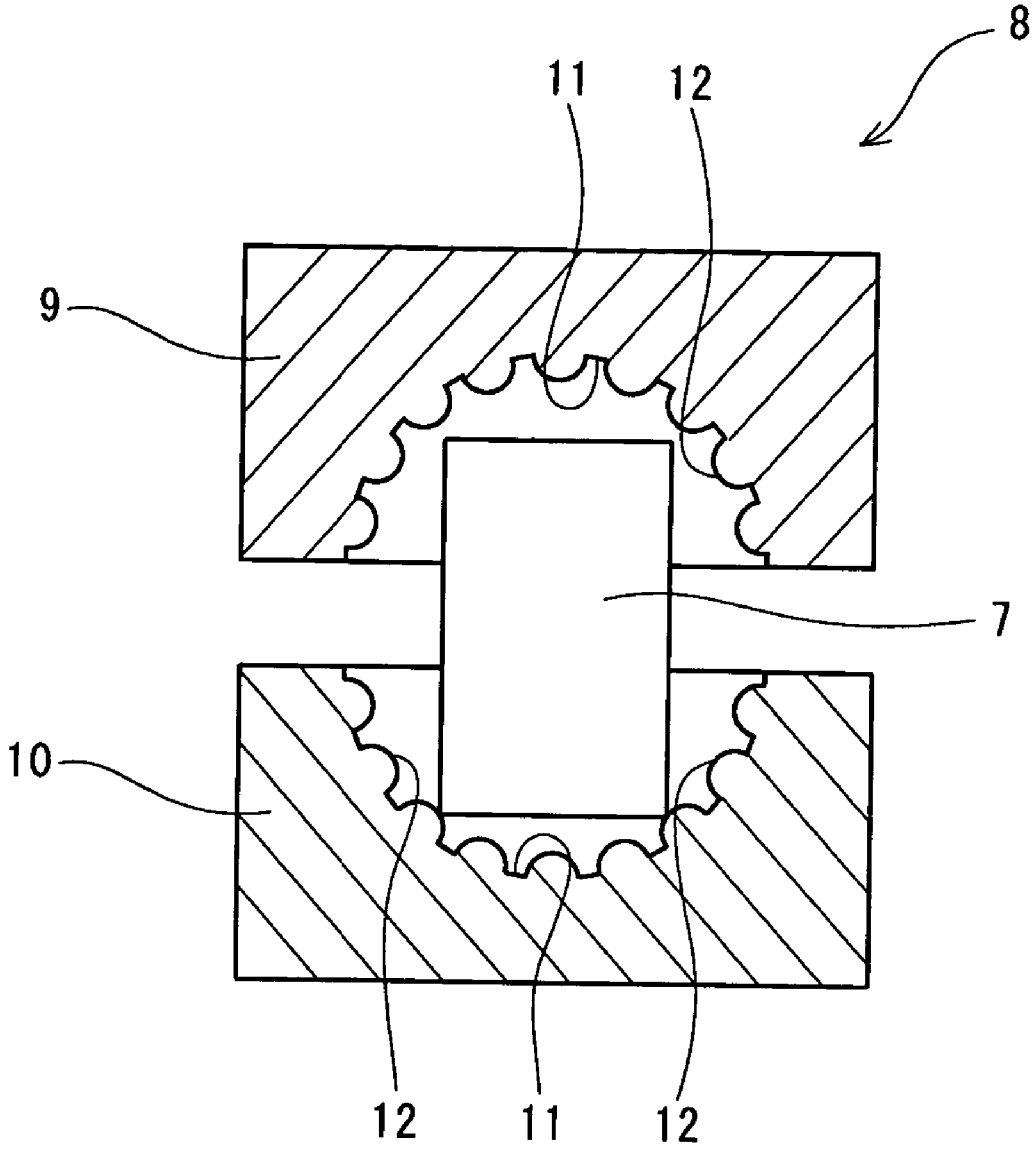
FIG. 4 is a sectional view showing a core mold to be used in the golf ball manufacturing method of FIG. 3 together with a preforming material.

Subsequently, the preforming material 7 is put in a core mold 8 shown in FIG. 4. The core mold 8 comprises an upper mold 9 and a lower mold 10. Each of the upper mold 9 and the lower mold 10 includes a hemispherical cavity surface 11. The upper mold 9 and the lower mold 10 are joined together so that a spherical cavity is formed. A projection 12 is formed on the cavity surface 11. The core mold 8 is clamped so that the preforming material 7 is pressurized and the rubber composition takes a spherical shape. The rubber composition is heated through the core mold 8 so that a rubber molecule causes a crosslinking reaction. Thus, the almost spherical core 2 is formed (STP3). The concave portion 6 is formed on the surface of the core 2. The concave portion 6 takes a shape obtained by inverting the shape of the projection 12.

A very small amount of the rubber composition leaks out of the parting line of the core mold 8. Therefore, a spew is generated on the surface of the core 2. The core 2 taken out of the core mold 8 is polished. Consequently, the spew is removed (STP4). The core 2 may be formed by injection molding.

Figure 5:
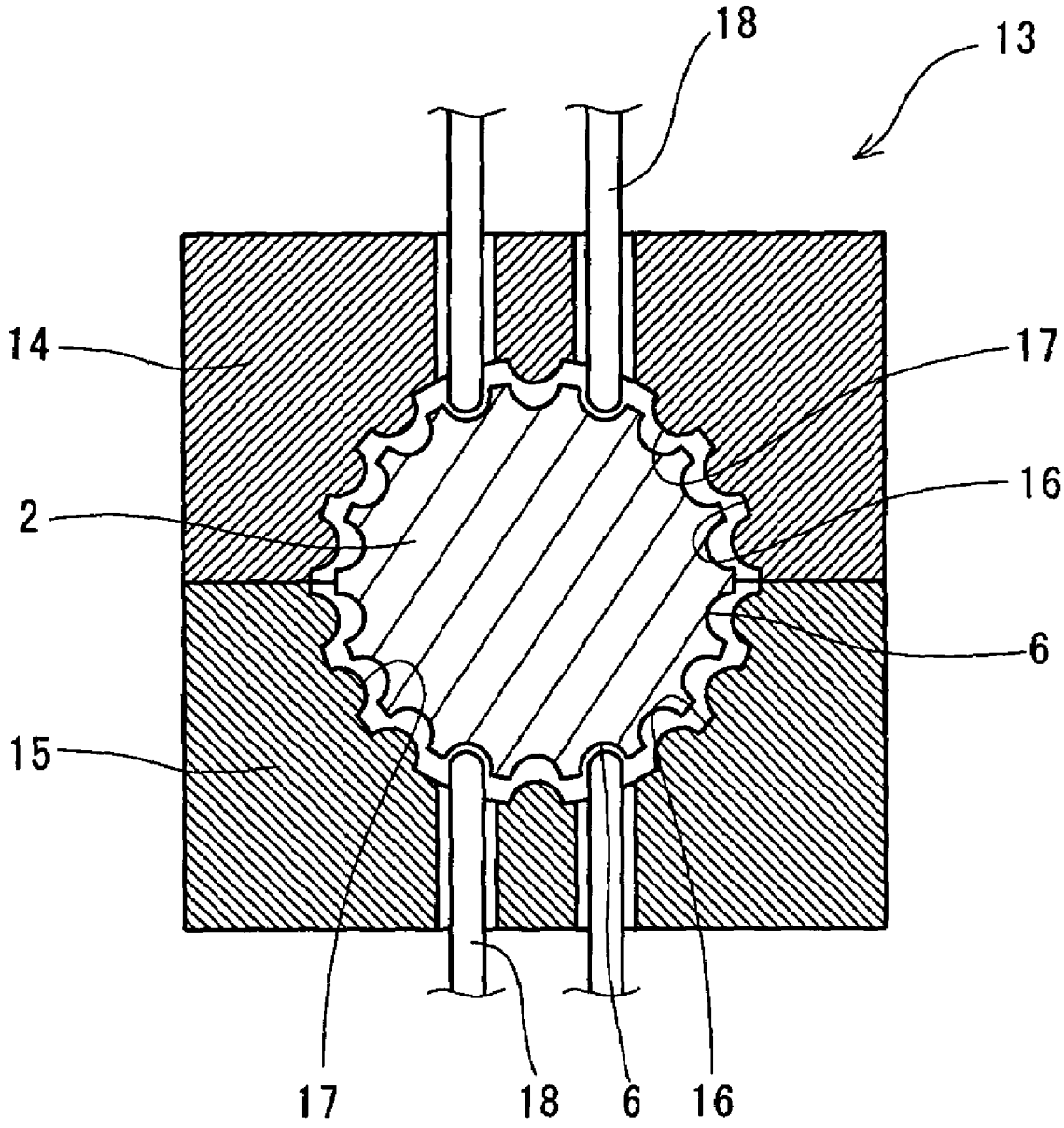
FIG. 5 is a sectional view showing a cover mold to be used in the golf ball manufacturing method of FIG. 3 together with a core.

Then, the core 2 is put in a cover mold 13 as shown in FIG. 5 (STP5). The cover mold 13 comprises an upper mold 14 and a lower mold 15. Each of the upper mold 14 and the lower mold 15 includes a hemispherical cavity surface 16. A large number of projections 17 are formed on the cavity surface 16. The projection pattern of the cover mold 13 is identical to that of the core mold 8. The cover mold 13 comprises a holding pin 18. The number of the holding pins 18 in each of the upper mold 14 and the lower mold 15 is 3 to 10. The core 2 is held on the center of the cavity by means of the holding pin 18. The position of the core 2 is determined in such a manner that the predetermined concave portion 6 abuts on the tip of the holding pin 18. Consequently, the concave portion 6 corresponds to the projection 17.

Next, a cover material (a molten synthetic resin) is injected into the gap between the core 2 and the cavity surface 16 through a gate which is not shown (STP6). Immediately before the injection is completed, the holding pin 18 is moved backward. The concave portion 6 corresponds to the projection 17 and a distance between the projection 17 and the core 2 is sufficiently large. Therefore, the projection 17 does not hinder the flow of the molten synthetic resin. The molten synthetic resin coagulates so that the cover 3 is formed. The dimple 4 is formed on the cover 3 by the projection 17. The dimple 4 takes a shape obtained by inverting the shape of the projection 17. By the manufacturing method, it is possible to obtain the golf ball 1 in which the position of the concave portion 6 corresponds to that of the dimple 4.

In order to easily carry out positioning, it is preferable that the depth of the concave portion 6 abutting on the tip of the holding pin 18 should be greater than the depths of the other concave portions 6. Their difference is preferably 0.5 mm to 2.0 mm.

Figure 6:
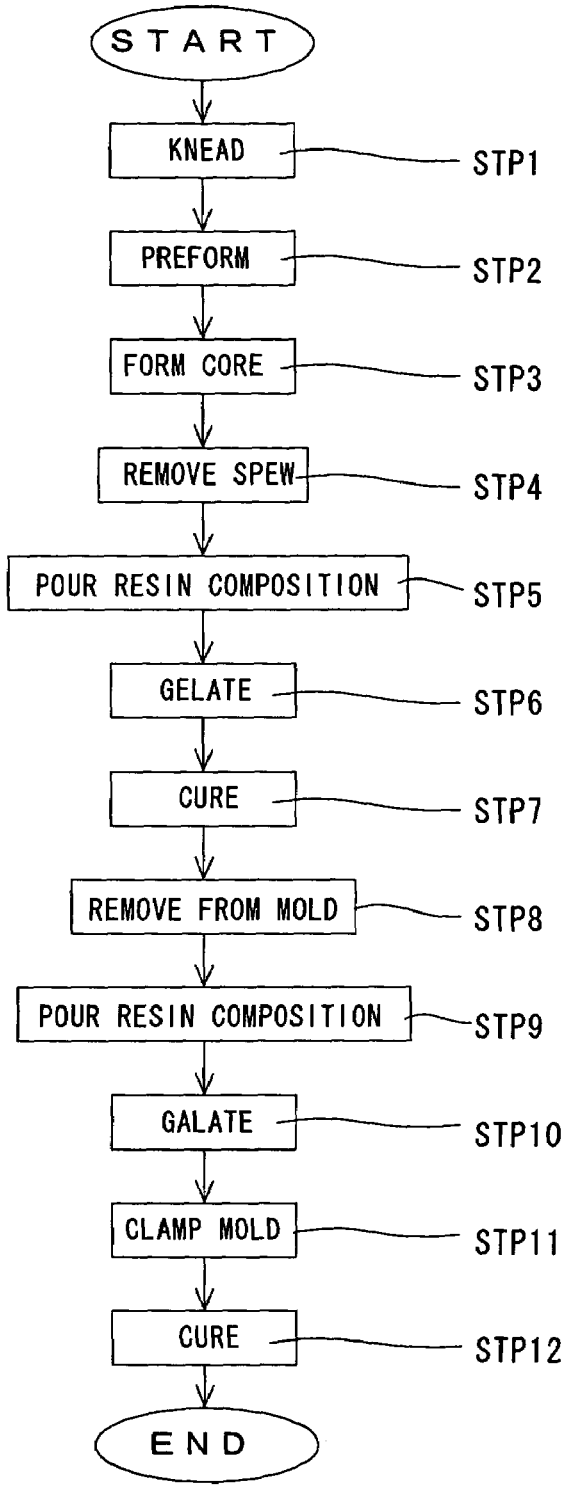
FIG. 6 is a flow chart showing a golf ball manufacturing method according to another embodiment of the present invention.
Figure 7:
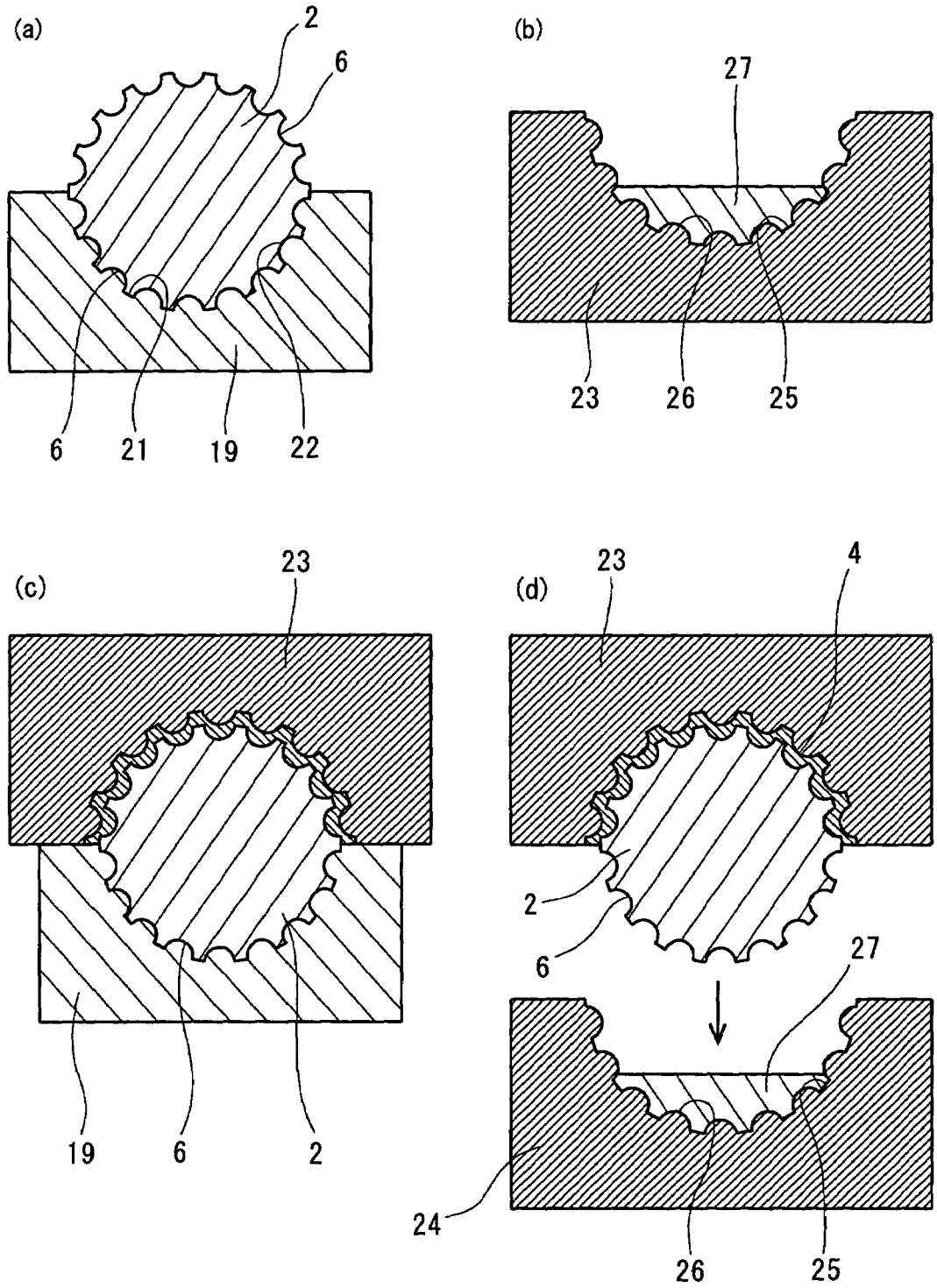
FIG. 7 is an explanatory view showing each step of the golf ball manufacturing method in FIG. 6.

FIG. 6 is a flow chart showing a golf ball manufacturing method according to another embodiment of the present invention. In the manufacturing method, the core 2 is obtained from a rubber composition in the same manner as in the manufacturing method shown in FIG. 3, and a spew is removed from the core 2 (STPs 1 to 4). The core 2 is fitted in a core holding mold 19 as shown in FIG. 7(*a*). The core holding mold 19 comprises a hemispherical cavity surface 21, and a large number of projections 22 are formed on the cavity surface 21. A projection pattern is identical to the pattern of the concave portion 6. By the fitting of the core 2, the projection 22 enters the concave portion 6. Consequently, the core 2 is positioned. By the positioning, the concave portion 6 is positioned to correspond to the projection 22. The lower mold 10 or the upper mold 9 of the core mold 8 shown in FIG. 4 may be used as the core holding mold 19.

Next, a cover mold is prepared. The cover mold comprises a first half mold 23 and a second half mold 24. Each of the first half mold 23 and the second half mold 24 includes a hemispherical cavity surface 25. A large number of projections 26 are formed on the cavity surface 25. The projection pattern of the cover mold is identical to that of the core mold 8. A reaction curing type resin composition 27 is poured into the first half mold 23 as shown in FIG. 7(*b*) (STP5). The typical resin composition 27 contains a polyurethane prepolymer and a curing agent. The resin composition 27 is heated through the first half mold 23 and gelates (STP6).

As shown in FIG. 7(*c*), then, the first half mold 23 of the cover mold and the core holding mold 19 are joined together. In this case, a position in a rotating direction of the first half mold 23 with respect to the core holding mold 19 is determined in such a manner that the projection 26 of the first half mold 23 corresponds to the concave portion 6. The first half mold 23 and the core holding mold 19 are joined together so that the resin composition 27 flows and the gap between the cavity surface 25 of the first half mold 23 and the core 2 is filled with the resin composition 27. The resin composition 27 is further heated and cured (STP7). Thereafter, the core 2 is removed from the core holding mold 19 (STP8). The core 2 is held in the first half mold 23 through the cured resin composition.

Subsequently, the reaction curing type resin composition 27 is also poured into the second half mold 24 in the same manner as the first half mold 23 (STP9). The resin composition 27 is heated through the second half mold 24 and gelates (STP10). As shown in FIG. 7(*d*), next, the cover mold is clamped (STP11). In this case, a position in a rotating direction of the second half mold 24 with respect to the first half mold 23 is determined in such a manner that the projection 26 of the second half mold 24 corresponds to the concave portion 6. By the mold clamping, the resin composition 27 flows so that the gap between the cavity surface 25 of the second half mold 24 and the core 2 is filled with the resin composition 27. The resin composition 27 is further heated and cured (STP12). Thus, the cover 3 is formed.

As described above, the projection patterns of the core mold 8, the core holding mold 19 and the cover mold are identical to each other. In the golf ball 1 obtained by the manufacturing method, the position of the concave portion 6 corresponds to that of the dimple 4.

The method of manufacturing the golf ball 1 shown in FIG. 1 is not restricted to the manufacturing methods shown in FIGS. 3 and 6. The projection pattern of the core mold is set to be identical to that of the cover mold and the core 2 is positioned in such a manner that the projection of the cover mold corresponds to the concave portion 6, and the cover 3 is thus formed. Consequently, it is possible to obtain the golf ball 1 having various excellent performances.

EXAMPLES

Experiment 1

Example 1

High cis-polybutadiene, a co-crosslinking agent, organic peroxide and a filler were leaded so that a rubber composition was obtained. The rubber composition was put in the core mold shown in FIG. 4 so that a core having a diameter of 41.9 mm was obtained. A concave portion having a depth of approximately 0.3 mm was formed on the surface of the core. Next, a cover was formed by using the method shown in FIGS. 6 and 7. Thermosetting type polyurethane was used as a cover material. A dimple having a depth of approximately 0.3 mm was formed on the surface of the cover. The cover had a Shore D hardness of 48. A well-known coating material was applied to the cover. Consequently a golf ball according to an example 1 was obtained. In the golf ball, a concave portion is present under each of the dimples.

Example 2

A golf ball according to an example 2 was obtained in the same manner as in the example 1 except that a core mold having a small inside diameter was used and the diameter of a core was set to be 41.5 mm.

Comparative Example 1

A golf ball according to a comparative example 1 was obtained in the same manner as in the example 1 except that a core mold having no projection on a cavity surface was used and the diameter of a core was set to be 41.1 mm. A concave portion is not formed on the core of the golf ball.

[Flight Distance Test]

A driver (W1) having a metal head was attached to a swing machine (produced by Golf Laboratories, Co., Ltd.). A golf ball was hit at a head speed of 45 m/sec, and an initial speed, a launch angle, a speed of an initial back spin, a carry (a distance between a launch point and a drop point) and a total flight distance (a distance between the launch point and a stationary point) were measured. Furthermore, a sand wedge (SW) was attached to the swing machine and the golf ball was hit at a head speed of 21 m/sec. Thus, the speed of the initial back spin was measured. A mean value of 20 data is shown in the following Table 1.

[Evaluation of Hitting Feeling]

50 advanced golf players were caused to hit a golf ball by using a driver, a sand wedge and a putter and a hitting feeling was evaluated in five stages of "1" to "5". In the evaluation, the softest hitting feeling was represented as "1", the hardest hitting feeling was represented as "5", and the evaluation of the golf ball according to the comparative example 1 was represented as "3". A mean mark of the 50 golf players is shown in the following Table 1.

TABLE 1

Result of Experiment 1

| | | | Example 1 | Example 2 | Com. example 1 |
|---|---|---|---|---|---|
| Projection on cavity surface of core mold | | | Yes | Yes | None |
| Nominal thickness (mm) | | | 0.4 | 0.6 | 0.8 |
| Maximum cover thickness T1 (mm) | | | 0.4 | 0.6 | 0.8 |
| Minimum cover thickness T2 (mm) | | | 0.4 | 0.6 | 0.5 |
| Difference T1 − T2 (mm) | | | 0.0 | 0.0 | 0.3 |
| Flight distance test | W1 | Initial speed (m/s) | 65.24 | 65.14 | 65.06 |
| | | Launch angle (degree) | 10.99 | 11.02 | 10.88 |
| | | Spin speed (rpm) | 2808 | 2894 | 2874 |
| | | Carry (m) | 208.8 | 207.7 | 206.7 |
| | | Total flight distance (m) | 224.1 | 221.9 | 220.6 |
| | SW | Spin speed (rpm) | 6976 | 7008 | 7011 |
| Hitting feeling | W1 | | 2.8 | 3.1 | 3.0 |
| | SW | | 3.0 | 2.7 | 3.0 |
| | Putter | | 3.1 | 3.0 | 3.0 |

As shown in the Table 1, the golf balls according to the examples 1 and 2 are more excellent in the flight distance than the golf ball according to the comparative example 1.

Experiment 2

Example 3

By using the same method as that in the example 1, a core having a diameter of 40.7 mm was obtained. A concave portion having a depth of approximately 0.3 mm was formed on the surface of the core. Next, a cover was formed by using the method shown in FIGS. 3 and 5. An ionomer resin was used as a cover material. A dimple having a depth of approximately 0.3 mm was formed on the surface of the cover. The cover had a Shore D hardness of 70. A well-known coating material was applied to the cover. Consequently, a golf ball according to an example 3 was obtained. In the golf ball, a concave portion is present under each of the dimples.

Comparative Example 2

A golf ball according to a comparative example 2 was obtained in the same manner as in the example 3 except that a core mold having no projection on a cavity surface was used and the diameter of a core was set to be 40.3 mm. A concave portion is not formed on the core of the golf ball.

[Flight Distance Test]

By using the same method as that of the experiment 1, a golf ball was subjected to a flight distance test. A mean value of 20 data is shown in the following Table 2.

[Evaluation of Hitting Feeling]

By using the same method as that of the experiment 1, a golf ball was subjected to the evaluation of a hitting feeling. In the evaluation, the softest hitting feeling was represented as "1", the hardest hitting feeling was represented as "5", and the evaluation of the golf ball according to the comparative example 2 was represented as "3". A mean mark of 50 golf players is shown in the following Table 2.

TABLE 2

Result of Experiment 2

| | | | Example 3 | Com. example 2 |
|---|---|---|---|---|
| Projection on cavity surface of core mold | | | Yes | None |
| Nominal thickness (mm) | | | 1.0 | 1.2 |
| Maximum cover thickness T1 (mm) | | | 1.0 | 1.2 |
| Minimum cover thickness T2 (mm) | | | 1.0 | 0.9 |
| Difference T1 − T2 (mm) | | | 0.0 | 0.3 |
| Flight distance test | W1 | Initial speed (m/s) | 64.42 | 64.40 |
| | | Launch angle (degree) | 10.96 | 10.96 |
| | | Spin speed (rpm) | 2915 | 2920 |
| | | Carry (m) | 203.6 | 203.7 |
| | | Total flight distance (m) | 219.0 | 218.9 |
| | SW | Spin speed (rpm) | 5349 | 5352 |
| Hitting feeling | W1 | | 2.8 | 3.0 |
| | SW | | 2.1 | 3.0 |
| | Putter | | 2.2 | 3.0 |

As shown in the Table 2, the golf ball according to the example 3 is more excellent in the hitting feeling than the golf ball according to the comparative example 2.

The above description is only illustrative and can be variously changed without departing from the scope of the present invention.

What is claimed is:

1. A golf ball comprising:

a solid core, and a cover having a nominal thickness of 0.1 mm to 1.2 mm disposed on the surface of the solid core, said core being provided with concave dimples on its outer surface and said cover being provided with concave dimples on its outer surface, said concave dimples on the outer surface of the core corresponding to and aligned with the concave dimples on the cover surrounding the core, wherein the thickness of the cover under the deepest portion of each dimple is in the range of 60 to 140% of the normal thickness of the cover.

2. The golf ball according to claim 1, wherein the cover has a thickness of 0.3 mm to 1.2 mm.

3. The golf ball according to claim 1, wherein the cover has a thickness of 0.3 mm to 1.0 mm.

4. The golf ball according to claim 1, wherein the dimples have a shape which is circular, non-circular, or both circular and non-circular.

5. The golf ball according to claim 1, wherein the core comprises more than one layer.

6. A golf ball comprising:

a solid core, and a cover having a nominal thickness of 0.1 mm to 1.2 mm disposed on the surface of the solid core, said core being provided with concave dimples on its outer surface and said cover being provided with concave dimples on its outer surface, said concave dimples on the outer surface of the core corresponding to and aligned with the concave dimples on the cover surrounding the core, wherein the thickness of the cover under the deepest portion of each dimple is in the range of 80 to 120% of the normal thickness of the cover.

7. The golf ball according to claim 6, wherein the cover has a thickness of 0.3 mm to 1.2 mm.

8. The golf ball according to claim 6, wherein the cover has a thickness of 0.3 mm to 1.0 mm.

9. The golf ball according to claim 6, wherein the dimples have a shape which is circular, non-circular, or both circular and non-circular.

10. The golf ball according to claim 6, wherein the core comprises more than one layer.

11. A golf ball comprising:

a solid core, and a cover having a nominal thickness of 0.1 mm to 1.2 mm disposed on the surface of the solid core, said core being provided with concave dimples on its outer surface and said cover being provided with concave dimples on its outer surface, said concave dimples on the outer surface of the core corresponding to and aligned with the concave dimples on the cover surrounding the core, wherein each concave dimple has a diameter which is 60% to 140% of the diameter of a corresponding dimple with which it is aligned.

12. The golf ball according to claim 11, wherein the cover has a thickness of 0.3 mm to 1.2 mm.

13. The golf ball according to claim 11, wherein the cover has a thickness of 0.3 mm to 1.0 mm.

14. The golf ball according to claim 11, wherein the dimples have a shape which is circular, non-circular, or both circular and non-circular.

15. The golf ball according to claim 11, wherein the core comprises more than one layer.

16. A golf ball comprising:

a solid core, and a cover having a nominal thickness of 0.1 mm to 1.2 mm disposed on the surface of the solid core, said core being provided with concave dimples on its outer surface and said cover being provided with concave dimples on its outer surface, said concave dimples on the outer surface of the core corresponding to and aligned with the concave dimples on the cover surrounding the core, wherein each concave dimple has a diameter which is 80% to 120% of the diameter of a corresponding dimple with which it is aligned.

17. The golf ball according to claim 16, wherein the cover has a thickness of 0.3 mm to 1.2 mm.

18. The golf ball according to claim 16, wherein the cover has a thickness of 0.3 mm to 1.0 mm.

19. The golf ball according to claim 16, wherein the dimples have a shape which is circular, non-circular, or both circular and non-circular.

20. The golf ball according to claim 16, wherein the core comprises more than one layer.

21. A golf ball comprising:

a solid core, and a cover having a nominal thickness of 0.1 mm to 1.2 mm disposed on the surface of the solid core, said core being provided with concave dimples on its outer surface and said cover being provided with concave dimples on its outer surface, said concave dimples on the outer surface of the core corresponding to and aligned with the concave dimples on the cover surrounding the core, wherein the depth of the dimple in the core is 60 to 140% of the depth of the dimple in the cover.

22. The golf ball according to claim 21, wherein the cover has a thickness of 0.3 mm to 1.2 mm.

23. The golf ball according to claim 21, wherein the cover has a thickness of 0.3 mm to 1.0 mm.

24. The golf ball according to claim 21, wherein the dimples have a shape which is circular, non-circular, or both circular and non-circular.

25. The golf ball according to claim 21, wherein the core comprises more than one layer.

26. A golf ball comprising:

a solid core, and a cover having a nominal thickness of 0.1 mm to 1.2 mm disposed on the surface of the solid core, said core being provided with concave dimples on its outer surface and said cover being provided with concave dimples on its outer surface, said concave dimples on the outer surface of the core corresponding to and aligned with the concave dimples on the cover surrounding the core, wherein the depth of the dimple in the core is 80% to 120% of the depth of the dimple in the cover.

27. The golf ball according to claim 26, wherein the cover has a thickness of 0.3 mm to 1.2 mm.

28. The golf ball according to claim 26, wherein the cover has a thickness of 0.3 mm to 1.0 mm.

29. The golf ball according to claim 26, wherein the dimples have a shape which is circular, non-circular, or both circular and non-circular.

30. The golf ball according to claim 26, wherein the core comprises more than one layer.

* * * * *